US005320566A

United States Patent [19]

Low, Jr.

[11] Patent Number: 5,320,566

[45] Date of Patent: Jun. 14, 1994

[54] SYSTEM AND METHOD FOR RESCUING AN INDIVIDUAL FROM A BODY OF WATER

[76] Inventor: Edward C. Low, Jr., 1621 Centinela Ave. #E, Santa Monica, Calif. 90404

[21] Appl. No.: 918,062

[22] Filed: Jul. 24, 1992

[51] Int. Cl.[5] ..... B63C 9/00

[52] U.S. Cl. ..... 441/80; 441/83

[58] Field of Search ..... 441/80, 83; 114/240 C, 114/241; 182/138

[56] References Cited

U.S. PATENT DOCUMENTS

| | | | |
|---|---|---|---|
| 600,355 | 3/1898 | Burton | 441/80 |
| 2,557,079 | 6/1951 | Cutri | 441/80 |
| 2,817,860 | 12/1957 | Fritz | 441/83 |
| 4,652,246 | 3/1987 | Thorgeirsson | 441/80 |

FOREIGN PATENT DOCUMENTS

| | | | |
|---|---|---|---|
| 88/03495 | 5/1988 | World Int. Prop. O. | 441/80 |

*Primary Examiner*—Sherman Basinger
*Attorney, Agent, or Firm*—Chris Papageorge

[57] ABSTRACT

A rescue system and method includes a net which is mounted on a bridge or overpass so that it generally hangs therefrom. Attachment ropes are secured to the upper edge portion of the net and to a suitable vehicle on the bridge or overpass. The net has lateral border straps which are preferably channeled so that a cable can movably pass therethrough. The lower edge portion of the net has a pair of hooks secured thereto to which a ballast weight is attached. The hooks have a quick release mechanism allowing the ballast to be released from the net when an imperiled person is in a rescue position adjacent the net. A pair of lifting ropes are connected to lower corners of the net which allow the bottom of the net to be pulled up and thereby enclose the individual therein and also allow the individual to be lifted out of the body of water.

16 Claims, 3 Drawing Sheets

SYSTEM AND METHOD FOR RESCUING AN INDIVIDUAL FROM A BODY OF WATER

BACKGROUND OF THE INVENTION

The present invention relates generally to rescue systems and methods and more particularly to improved rescue systems and methods for removing an imperiled person from a moving body of water.

Rescuing a person from a body of water is becoming a more common problem due to the population growth of areas which are subject to unexpected torrential rainfall. In addition, many heavily populated areas not uncommonly experience flooding due to dam rupture as well as many other causes. The resulting flood waters typically move very quickly through an area and with great force due to the high volume of water involved.

Prior art systems and methods for rescuing a person from a moving body of water have included simply throwing a rope to the imperiled person. Often, a rope may be attached to a flotation device. However, one of the primary shortcomings of such systems and methods is that the person to be rescued is required to have and utilize a very high degree of strength in order to maintain a firm grip on such a rope or flotation device because of the relatively high speed at which he is moving in the water. This becomes even more difficult to accomplish if, as is common, the person in the body of water is unconscious or in a weakened state due to hypothermia or due to exhaustion from attempting to swim to safety or due to injury or inhalation of water. Indeed, since it is very common for flood waters to include a very large mass of water moving at very high speeds, it becomes much more likely that an imperiled person will become quickly weakened due to exhaustion, personal injury or water inhalation. Moreover, it is often difficult for the person to be rescued to be able to grab a hold of such a rope or flotation device because of his speed relative to the rescuing person. In addition, because of this often great difference in relative speed between the rescuer and rescuee, the rescuer is often unable to accurately throw the rope close enough to the rescuee to allow him to grab it. The high degree of force with which the flood waters push the imperiled individual require a correspondingly high degree of strength to grab a hold of and maintain a firm grip on such a rope or flotation device in order for the rescue to be successful. Consequently, regardless of whether the rescue system equipment is thrown to a drowning person from a bridge, a shore or a helicopter, these problems often prevent such a rescue operation from being successful.

A rescue system and method is thus needed that does not require a high degree of strength from the rescuee in order for the rescue operation to be successful. A rescue system and method is also needed that is capable of rescuing an unconscious or otherwise passive person from a moving body of water. A rescue system and method is also needed that may be set up easily and quickly in order to reach the imperiled individual in time for the rescue operation to be successful.

SUMMARY OF THE INVENTION

It is a principal object of the present invention to provide a rescue system and method which can effectively rescue a weakened or injured individual from a body of water.

It is another object of the present invention to provide a rescue system and method which can effectively rescue an unconscious or otherwise passive individual from a body of water.

It is another object of the present invention to provide a rescue system and method which is capable of rescuing a person from a moving body of water.

It is still another object of the present invention to provide a rescue system and method which is able to be set up quickly and easily.

It is another object of the present invention to provide a rescue system and method which may be mounted and hung from a bridge or overpass.

It is another object of the present invention to provide a rescue system and method which may be quickly positioned in order to enable timely rescue of an imperiled person.

It is another object of the present invention to provide a rescue system and method which is portable to facilitate transportation to a desired rescue area.

It is also another object of the present invention to provide a rescue system and method which may be attached to and operated from a vehicle.

The rescue system and method of the present invention is specifically designed to generally enclose an imperiled person in a net while the person is in a body of water. The system and method of the present invention is also specifically designed to operatively position a net in a body of water so that the net can generally hold and prevent excessive movement of an imperiled person in the water in order to facilitate removal of the person therefrom.

Essentially, the net is immersed in a body of water and properly positioned therein relative to the current flow and relative to the position of the imperiled person in the water so that the water will generally move the imperiled person up against the net. A ballast and a pair of lifting ropes attached to the net structures generally prevent the net from giving way and thus block the person from further movement in the water. The pair of lifting ropes are attached to lowermost portions of the net, enabling the lowermost portions to be generally picked up (after the ballast is released from the net) thereby generally holding these portions over the person and generally enclosing the person within the net. Once the person is properly enclosed in the net, the ropes are reeled in thereby lifting the net and the person contained therein out of the water enabling the person to be put in a place of safety.

The system of the invention is especially effective in rescuing an individual from a body of water flowing underneath a bridge or other similar overpass. The net structure is attached at its upper end portion via attachment ropes to suitable bridge structures or simply to a truck or other vehicle on the bridge. Once the net upper end portion is properly secured, the net is simply dropped from the bridge into the body of water and positioned so that the water will carry the individual up against the net. The three attachment ropes are also attached at upper ends thereof to suitable bridge structures or to suitable vehicle structures enabling the ropes to be reeled in once the rescuee is properly contained in the net. The net is dimensionally large enough to engage and hold the individual thereagainst, preventing further movement thereof, and enabling the completion of the rescue operation.

It is an important advantage of the present invention that the rescuee is generally completely contained in the net. Because of this unique feature, the person does not have to utilize his own strength to grab or hold any rescue device or rescue equipment in order to be successfully rescued. Indeed, the person to be rescued need not hold or do anything and may instead be completely passive. This is especially important because the person to be rescued may be unconscious or be in such a weakened state as to preclude his effective cooperation in the rescue operation. This unique feature of the present invention is in sharp contrast to prior art systems which typically require the person to be rescued to be conscious, alert and to have a certain degree of strength necessary to grab a hold of the rescue equipment thrown out to him or her.

Since the present invention is relatively lightweight and relatively simple in structure and use, it is easily portable allowing it to be carried on a truck or simply carried by one or more rescue personnel. The simplicity of the present invention allows it to be quickly and easily unpacked and properly set up. Consequently, the present invention may be quickly transported to a place where it is needed to rescue an imperiled person and quickly set up and lowered into the water in time to rescue that person. The simplicity of the present invention also allows it to be quickly dissasembled and packed. Thus, after the present invention has been used to perform one rescue operation, it may be disassembled and packed and transported to another rescue area to perform another rescue operation.

It is also an important advantage of the invention that a rescuer need not enter the body of water or even be proximal the body of water in order to successfully rescue the individual. Thus, the rescuer need not risk his own life to rescue an imperiled person. In contrast, some prior art systems require, for effective use of such prior art systems, that the rescuer actually personally attach rescue equipment to the imperiled person. With such prior art systems, the rescuer may be required to subject himself or herself to potentially serious injury from the flailing arms and legs of the imperiled individual who is often in a state of panic. In addition, with such prior art systems, the rescuer may be subjected to the risk of serious injury caused by being struck by floating tree limbs or other such debris moving often very quickly in the water. Moreover, it is frequently very difficult to attach a device to or personally reach a drowning person who is often being carried along very quickly by the water currents. Thus, the system and method of the present invention has a much greater chance of success in rescuing an imperiled person from a body of water than many other conventional prior art systems and methods.

DETAILED DESCRIPTION OF THE PREFERRED EMBODIMENT

Figure 1:
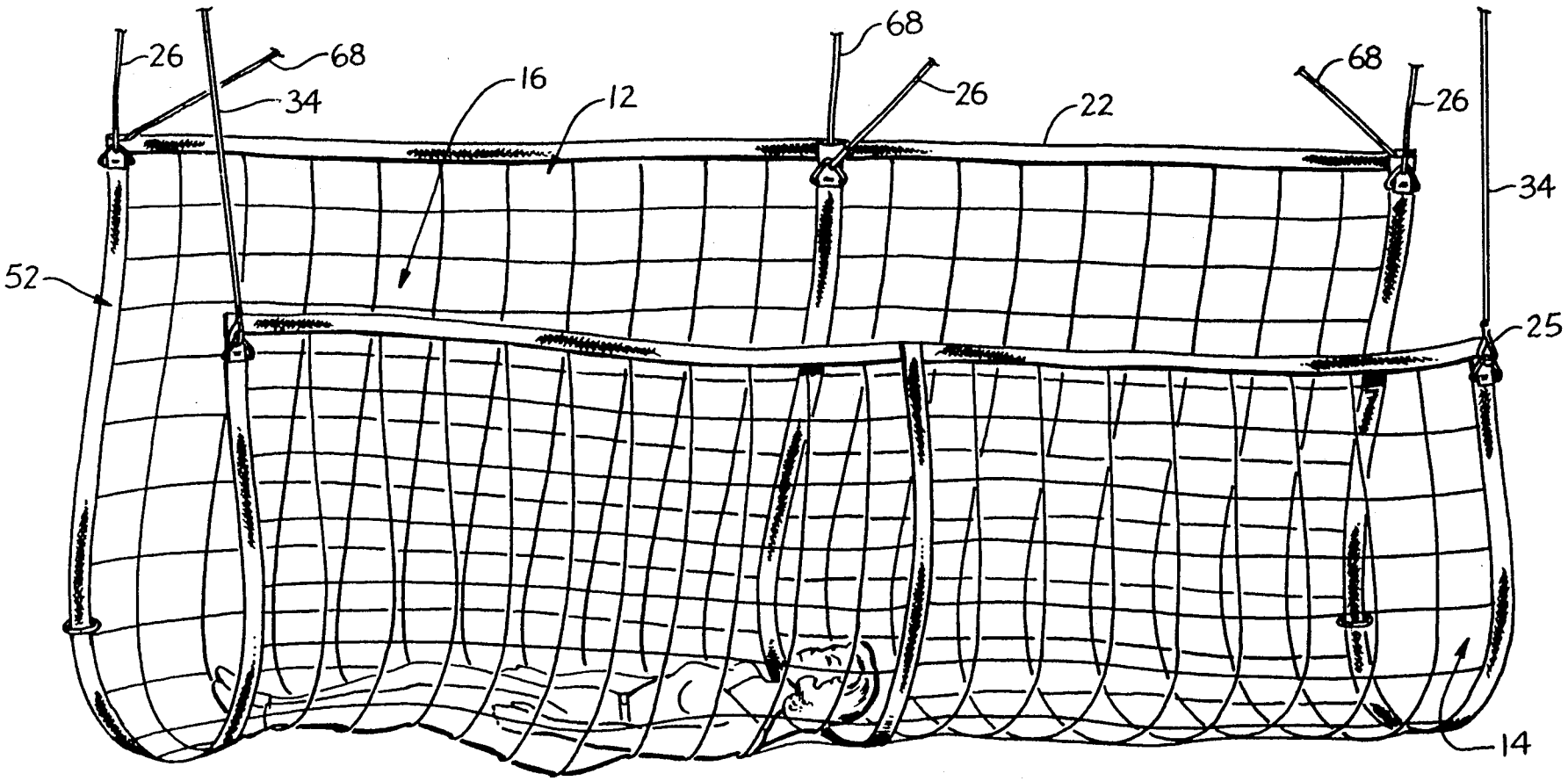
FIG. 1 is a perspective view of the present invention showing the net thereof partly enclosing an imperiled person in order that the person in the net may be pulled from the water to a place of safety.
Figure 2:
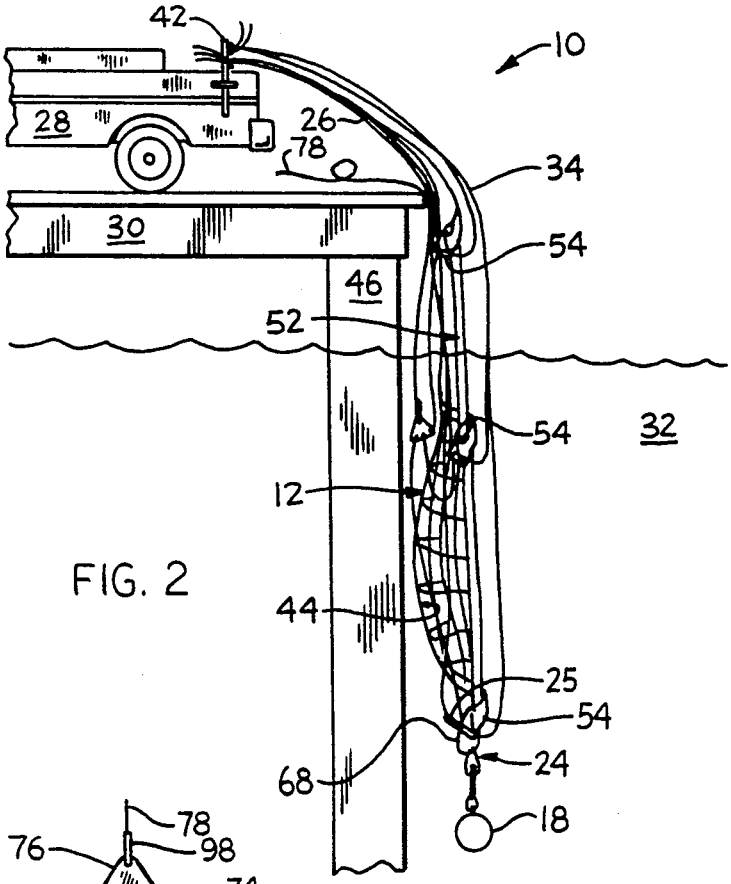
FIG. 2 is a side perspective view of the system of the present invention showing the net thereof attached to a truck and hanging from a bridge.

Referring now to the drawings, the rescue system of the present invention is generally designated by the numeral 10. The system 10 includes a flexible member which is preferably simply a net 12 which preferably includes a lower portion 14 and an upper portion 16. The system 10 preferably also includes a ballast 18 which is attached to the net 12 preferably at a lower edge portion 20 thereof by means of preferably a ballast hook 20.

The system 10 preferably includes three attachment ropes or straps 26 which preferably connect the net 12 at an upper edge portion 22 thereof to a truck 28 located on a bridge or overpass 30, as shown in FIG. 1. This allows the net 12 to generally hang down from the bridge or overpass 22, as shown in FIG. 1. The net 12 is preferably positioned so that it is at least partially immersed in a body of water 32 under the bridge 30. More preferably, the net 12 is also positioned so that it generally faces the direction of current flow enabling it to generally block the path of an imperiled person being carried along by the water currents. Thus, this positioning enables the net 12 to generally block movement of and catch the imperiled person who is, in effect, pushed into the net 12 by the water currents.

A pair of lifting ropes 34 are preferably also provided which have preferably double safety type of rope hooks 25 at lower end portions 36 thereof so that the ropes 34 may be hooked up to corner portions 40 of the lower portion 14 of the net 12. The ropes 34 and hooks 25 enable the lower portion 14 to be pulled up in order to generally curl the lower portion 14 up and move the net 12 into a trough configuration and thereby generally enclose an imperiled person within the net 12, as shown in FIG. 1. The ropes 34 are preferably attached at upper end portions 38 thereof to the truck 28, and, more preferably, the upper portions 38 are coiled around a looped portion 43 of a rope stake 42 which is preferably secured to a sleeved structure of the truck 28. The rope stake 42 allows the use of a very long length of rope because it can essentially take up slack in the rope, thereby allowing greater leeway in the positioning of the truck 28 relative to the net 12. The ropes 34 may simply be pulled up by hand to thereby manually lift and generally remove the net 12 and the rescued person from the water 32. Alternatively, the upper portions 38 may be secured to a drum structure (not shown) or other such means for reeling in the ropes 34 in order to lift the rescuee out of the water 32.

The net 12 is preferably approximately rectangular and preferably is approximately 17 feet wide and approximately 20 feet long. Once immersed in the water 32, the water currents will typically form a pocket 44 in the net 12 such that the width of the net 12 becomes approximately 2 feet less than the flattened out width. Thus, this width dimensioning of the net 12 enables the net 12 to generally fit between the pylons 46 of the bridge or overpass 30. The pylons 46 are typically spaced approximately 15 to 20 feet apart. The openings or apertures 48 of the net 12 are preferably approximately one foot in diagonal measurements. This dimensional sizing enables the openings 48 to be large enough both to allow sufficient quantities of water to pass therethrough to minimize waterflow drag and to avoid picking up unwanted debris. This dimensional sizing also enables the openings 48 to be small enough to facilitate containing and holding the rescued person within the net 12.

The net 12 preferably includes netting straps 50 which are preferably secured together at suitable portions thereof to form the netting structure. The straps 50 are preferably composed of a nylon material for strength and water resistance. However, other suitable materials may also be utilized. The net 12 is preferably laterally bordered by lateral straps 52 having a preferably two inch width. Lateral border straps 52 are preferably provided with rings 54 for attachment of the rope hooks 25 thereto. The rings (preferably delta type rings) 54 are preferably attached to the lateral border straps 52 at preferably lower end portions 56 thereof and at preferably generally medial portions 58 thereof, as shown. This placement of the rings 54 enables the ropes 34 to be attached to the net 12 at locations which enable it to accommodate different depths of water or to accommodate different sizes of persons to be rescued.

In addition, rings 54 are also connected to upper end portions 60 of lateral border straps 52 and central border straps 64 in order to allow the attachment ropes 26 to be secured to the net 12 for attachment to the truck 28, as described hereinabove. Alternatively, however, instead of being attached to the truck 28, attachment ropes 26 may simply be secured to a railing or other suitable structure of the bridge or overpass 30. Similarly, the ropes 34 may alternatively also be attached to the railing or other suitable structures of the bridge or overpass 30 rather than the truck 28, if desired. In addition, both or either ropes 34 and 26 may be simply held by persons suitably located on the bridge 30, if desired.

The netting straps 50 preferably are of approximately one inch width and approximately 1/16 thickness and of preferably nylon composition. This composition and sizing of the straps 50 allows them to have sufficient strength to withstand the forces exerted thereon by a person who is being carried along by a very rapidly moving body of water. For example, this composition and sizing of the straps 50 enables them to withstand the forces generated by flash flood waters moving at speeds of 30 miles per hour through a viaduct. In addition, since the net straps 50 are generally flat at the faces 62 of the net 12 where they are likely to come in contact with the rescued person, the pressures resulting from their contact with the rescuee will not generally be high enough to cause any serious bodily injury to the rescuee. Although the net 12 may alternatively be constructed of netting ropes, the circular cross-sectional construction of such ropes may, due to their smaller contact area (with the rescuee), produce sufficiently high pressures on the rescuee to cause significant injury thereto. Consequently, the strap construction provides a higher degree of safety than the rope construction.

Generally, it is preferable that the net 12 be generally vertically positioned in the body of water 32 and oriented so that its face 62 is generally approximately normal to the direction of water flow therethrough in order that it be more effective in generally blocking movement in the water 32 of the person to be rescued. The ballast 18 is provided to generally keep the net 12 in this preferred approximately vertical position when immersed in the water 32. The ballast 18 also preferably generally keeps the net 12 in a generally approximately flat configuration in order to enhance its effectiveness in both blocking and capturing the person to be rescued. This is generally accomplished by the provision of a central border strap 64. The central border strap 64 in conjunction with the lateral border straps 52 and the ballast 18 mounted at the lower edge portion 20 of the lower portion 14 of the net 12 tends to keep the net 12 in a generally flat configuration, i.e., both laterally and vertically in an extended position. This also maximizes the blocking area of the net 12 thereby enhancing its effectiveness. However, water currents will typically produce a pocket 44 in the net so as to move the lateral edges 23 thereof inwardly up to approximately a total of 2 feet.

Figure 3:
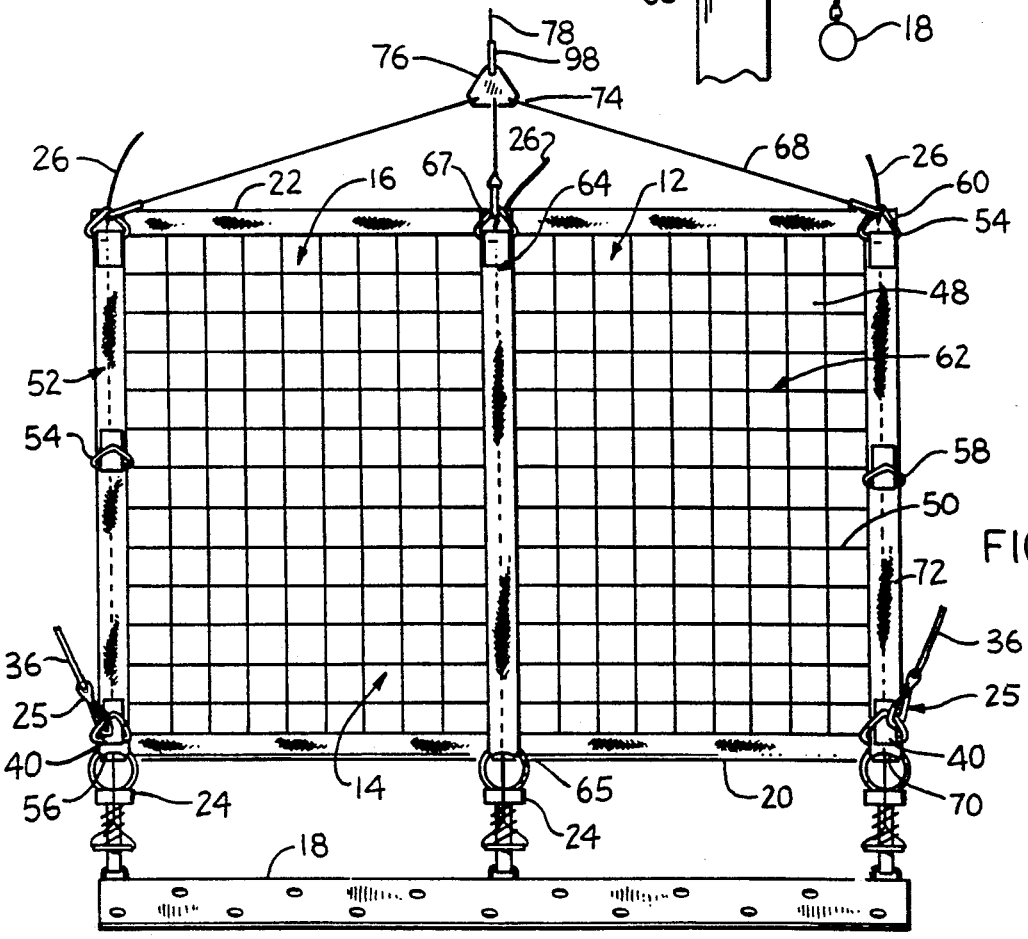
FIG. 3 is a front view of the net and other components of the system of the present invention.
Figure 4A:
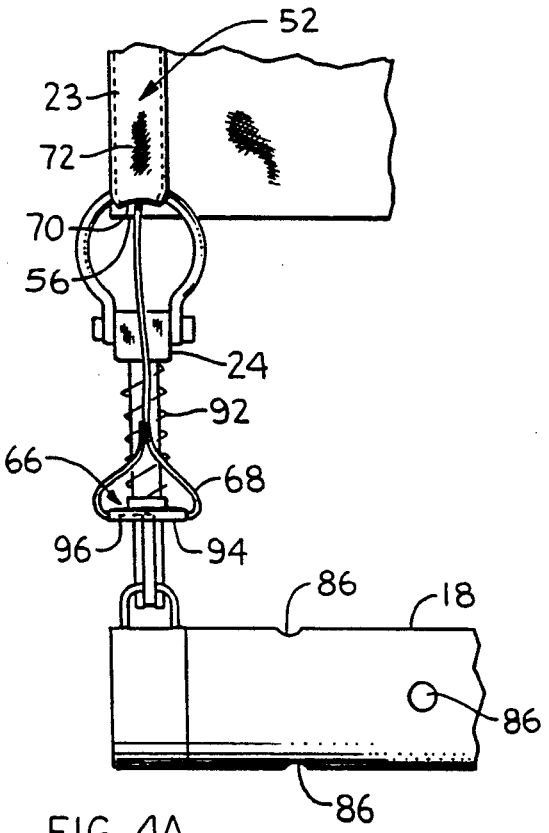
FIG. 4A is a front isometric view of the ballast hook, release mechanism thereof and portions of the cable, ballast and net of the system of the present invention.
Figure 4B:
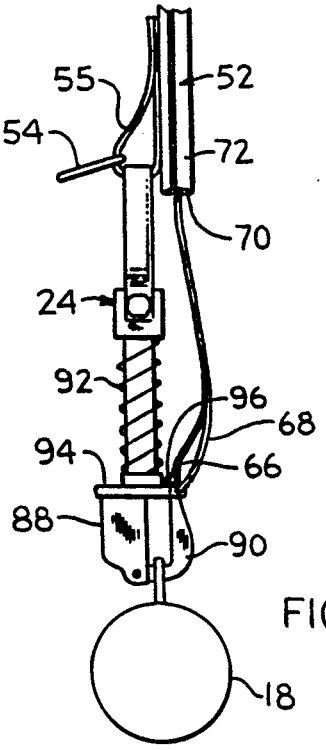
FIG. 4B is a side isometric view of the ballast hook, release mechanism thereof and portions of the cable, ballast and net of the system of the present invention.
Figure 5:
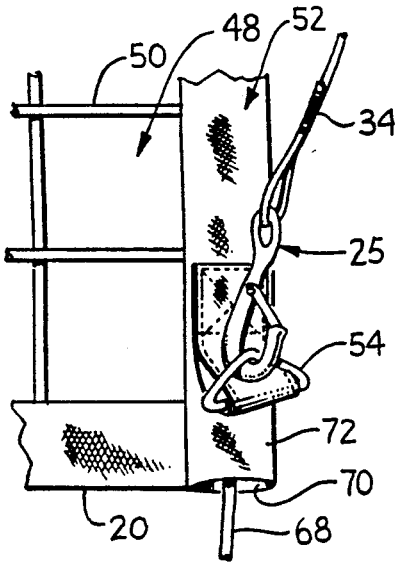
FIG. 5 is a perspective view of the double safety hook of the system of the invention shown connected to a ring at a lateral border strap.
Figure 6:
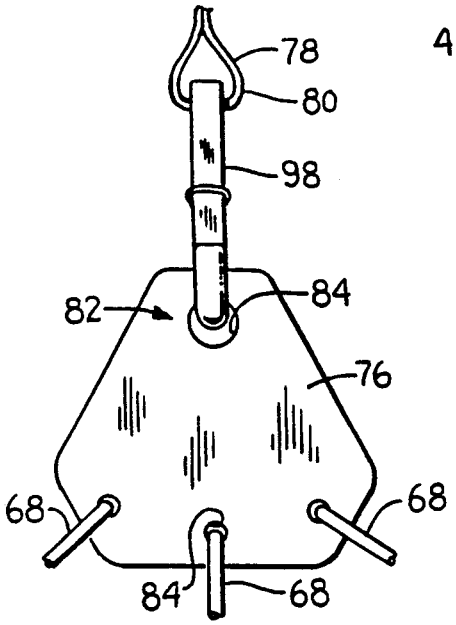
FIG. 6 is a plan view of the clew plate of the present invention also showing the cables connected to the bottom portion thereof and the control cable connected to a top portion thereof.
Figure 7:
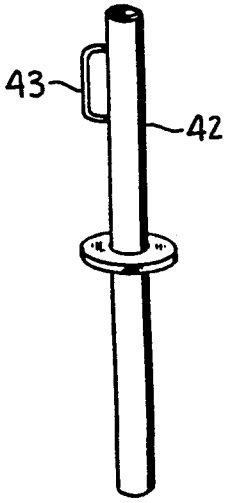
FIG. 7 is a perspective view of the rope stake of the system of the present invention.

The ballast hooks 24 are preferably attached to lower edge portions 65 of the central border strap 64 and lower end portions 56 of lateral border straps 52 preferably by means of looped flaps 55. The ballast hooks 24 are preferably provided with a quick release mechanism 66. Cables 68 are attached to the ballast hooks 24 and the quick release mechanism 66. In operation, a generally vertical upward movement of the cables 68 will activate the quick release mechanism 66 and result in release of the ballast 18 thereby allowing it to drop from the net 12. The mechanism 66 preferably includes a hook main body 88, a hook latching member 90 and a spring 92 which presses against a plate 94 thereby keeping the member 90 in a locked or latched position against an indentation or aperture 96 on the plate. The unique construction of the quick release mechanism 66 precludes lateral forces from activating release mechanism 66. Therefore, the quick release mechanism 66 cannot be activated prior to its desired time by water current forces or generally by forces other than upward movement of the cable 68. Thus, the ballast 18 cannot be released prior its desired time thereby otherwise hampering rescue operations. The central border strap 64 and lateral border straps 52 are preferably sleeved or channeled so that the cable 68 may movably extend through the channel or open area 70 of the sleeves 72 of straps 52 and 64 while being protected from the elements and from entanglement with other lines, each other or debris which may be floating in the water 32. The cables 68 preferably extend generally upwardly and outwardly from the open areas 70 of the sleeves 72 of upper end portions 60 and 67 of the straps 52 and 64, and are preferably connected at upper end portions 74 thereof to a clew plate 76 which is positioned generally above the net 12. A control cable 78 is preferably connected at a lower portion 80 thereof to a hook (preferably a double safety hook) 98. The hook 98 is preferably connected to an upper portion 82 of the clew plate via insertion of hook 98 into hole 84 of plate 76, as shown in FIG. 3. The control cable 78 allows quick and easy activation of the quick release mechanism by simply manually pulling the cable 78. The pulling force required to activate the quick release mechanism 66 is preferably high enough (approximately 25 pounds of force) to prevent accidental activation thereof.

In operation, the net 12 is dropped into the water 32 so that it is generally immersed in the body of water 32. The ballast 18 which is connected to the lower portion 14 of the net 12 allows the net 12 to be generally flat and preferably positioned approximately perpendicular to the direction of water flow, as previously stated. The ballast preferably has ballast holes 86 therein positioned approximately 12 inches apart and at opposing surfaces thereof. The holes 86 are preferably approximately one inch in diameter and are preferably spaced 90 degrees apart, as shown. The holes 86 allow water to flow therethrough and thereby facilitate dropping the net into the water 32. When the person to be rescued floats up against the net 12, the quick release mechanism 66 is preferably manually activated by means of the control cable 78 thereby allowing release of the ballast 18. Once the ballast 18 drops from the net 12, the ropes 34 are pulled up thereby generally lifting the lower portion 14 of the net 12 to generally enclose and retain the rescuee in the net 12. Once the rescuee is generally enclosed and secured in the net 12, preferably both the ropes 26 and ropes 34 are pulled upward, thereby lifting the entire net structure 12 and person contained therein out of the body of water 32 and onto the bridge 30 or other place of safety. The ropes 34 and 26 may be either manually pulled up or simply attached to the truck 28 so that the truck 28 may be driven in a direction which results in movement of and removal of both the net 12 and person contained therein from the water 32.

The net structure 12 of system 10 of the present invention may also be suspended from suitable structures located at each of the banks or shores of the viaduct or moving body of water 32 rather than from bridge or overpass 30. In addition, the net 12 may also optionally be held via ropes 26 and ropes 34 by persons located at each of the banks or shores of the viaduct or moving body of water 32. In this type of set-up, one person at one of the banks or shores may operate the control cable 78 while also controlling one of the attachment ropes 26 and one of the lifting ropes 34. Generally, when the net 12 is suspended this way, the pulling force on the ropes 34 and 26 instead of being generally vertical will be angular or approximately horizontal. Moreover, in operation, once the rescued person is enclosed in the net 12, the net 12 and person contained therein are pulled to one side of the viaduct and placed on the bank or the shore rather than lifted onto the bridge 30. This type of set-up also allows the persons holding and operating the components of the system 10 to move the net 12 toward and up against the imperiled individual in the water 32 in order to more quickly and effectively capture the individual in the net 12.

Accordingly, there has been provided, in accordance with the invention, a rescue system which is safer and more effective than many other prior art rescue systems and methods as well as being faster to set up and use. It is to be understood that all the terms used therein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include all such alternatives, embodiments, modifications, and variations that fall within the spirit and scope of the invention as set forth in the claims hereinbelow.

I claim:

1. A system for rescuing an imperiled individual from a body of water, comprising:

a net for blocking undesired movement of the individual in the body of water and for at least partly enclosing the individual therein, said net including netting straps having generally flat faces and having a first width;

said net further including first and second lateral border straps, and a centrally located border strap, said first and second lateral border straps and said centrally located border strap also having generally flat faces and each having a second width, each said second width being greater than said first width;

a ballast attached to lower ends of said first an second lateral border straps and said centrally located border strap, said first and second lateral border straps, said centrally located border strap, and said ballast tending to keep said net in a generally flat configuration when blocking undesired movement of the individual so as to maximize the blocking area of said net; and means for removing at least a portion of said net together with the individual from the body of water.

2. The system of claim 1 wherein said netting straps are of approximately one inch width and approximately one sixteenth inch thickness and said netting straps are composed of nylon.

3. The system of claim 2 wherein said means for removing is a vehicle.

4. The system of claim 1 wherein said ballast is releasably connected to said net.

5. The system of claim 1 wherein said not includes apertures of approximately one foot in diagonal measurement.

6. A system for rescuing an imperiled individual from a body of water, comprising:

a net for blocking undesired movement of the individual in the body of water and for at least partly enclosing the individual therein;

means for removing at least a portion of said net together with the individual from the body of water, said means for removing including a rope stake for insertion into a structure located generally outside the body of water, said rope stake having a looped portion, and a pair of ropes connected at upper end portions thereof to said looped portion and at lower end portions thereof to a lower portion of said net.

7. A system for rescuing an individual from a body of water, comprising:

a net having an upper edge portion and a lower portion;

a plurality of attachment straps connected to the upper edge portions of said net and to a vehicle located generally outside the body of water;

a rope stake inserted into a structure of the vehicle;

a pair of ropes attached at lower end portions thereof to the lower portion of said net and at upper end portions thereof to said rope stake in order to move said net into a configuration for at least partly enclosing the individual in order to remove the individual together with said net from the body of water.

8. The system of claim 7 further including a ballast detachably connected to a lower portion of said net in order to position said net in the body of water for enhancing effective blocking of said net, said ballast having a plurality of holes for allowing water to pass therethrough.

9. The system of claim 8 further including:

a cable;

a hook connected to said ballast;

a quick release mechanism connected to said hook and to said cable for manual detachment of said ballast from said net from a location generally distal of said hook.

10. The system of claim 9 wherein said net includes a strap laterally bordering said net, said strap having a channel therein extending generally entire length thereof for allowing said cable to movably pass therethrough in order to guide said cable and to generally protect and prevent entanglement of said cable.

11. The system of claim 9 wherein said quick release mechanism includes:

a main body;

a latch member rotatably connected to said main body;

a plate slidably mounted on said main body and connected to said cable, said plate having an indentation, the indentation receiving said latch member to enable said latch member to retain said ballast in said hook;

a spring mounted on said main body and engaging said plate, said spring exerting a force on said plate in order to retain said latch member in said indentation, generally upward movement of said cable disengaging said plate from said latch member to allow weight of said ballast to rotate said latch member and release said ballast from said hook.

12. The system of claim 7 further including:

a first pair of rings attached to lower corner portions of said net;

a second pair of rings attached to medial portions of said net, positioning of said pairs of rings at said lower corner and medial portions allowing adjustment of dimensional size of a trough formed by said net and adjustment of degree of immersion of said net in the body of water by selective attachment of said pair of ropes to said first pair of rings or to said second pair of rings.

13. The system of claim 7 wherein said rope stake is removably insertable into the vehicle structure and has a looped portion to enable the pair of ropes to be coiled around said looped portion.

14. The system of claim 7 wherein said net is dimensioned and includes netting straps having generally flat faces.

15. A method for rescuing an imperiled individual from a body of water, comprising:

providing a net;

providing a ballast;

detachably securing said ballast to said net at a lower portion thereof;

providing a cable;

providing a hook secured to a lower portion of said net, said hook provided with a quick release mechanism;

providing said net with a member having a channel extending generally entire length thereof so that said cable can pass therethrough in order to guide said cable and to generally protect and prevent entanglement of said cable, said cable attached to said quick release mechanism an extending through said channel and extending from an upper portion of said net in order to allow manual detachment of said ballast from said net, said quick release mechanism responsive to generally upward movement of said cable in order to generally preclude inadvertent activation of said quick release mechanism;

positioning said net so that it generally blocks movement of the individual in the water;

moving said net into a configuration allowing it to generally at least partly enclose the individual therein;

removing said net together with the individual at least partly enclosed therein from the body of water.

16. A system for rescuing an imperiled individual from a body of water, comprising:

a net for blocking undesired movement of the individual in the body of water and for at least partly enclosing the individual therein;

means for removing at least a portion of said net together with the individual from the body of water;

a ballast connected to said net in order to generally keep said net generally vertically positioned to enhance effective blocking of said net;

a cable;

a hook connected to said cable and to said ballast;

a main body;

a latch member rotatably connected to said main body;

a plate slidably mounted on said main body and connected to said cable, said plate having an indentation, said indentation receiving said latch member to enable said latch member to retain said ballast in said hook;

a spring mounted on said main body and engaging said plate, said spring exerting a force on said plate in order to retain said latch member in said indentation, generally upward movement of said cable disengaging said plate from said latch member to allow weight of said ballast to rotate said latch member and release said ballast from said hook.

* * * * *